US005159981A

United States Patent [19]

Le

[11] Patent Number: 5,159,981

[45] Date of Patent: Nov. 3, 1992

[54] FLAPPER VALVE

[75] Inventor: Nam V. Le, Lewisville, Tex.

[73] Assignee: Otis Engineering Corporation, Dallas, Tex.

[21] Appl. No.: 718,214

[22] Filed: Jun. 20, 1991

[51] Int. Cl.[5] ..... E21B 34/06; F16K 15/03

[52] U.S. Cl. ..... 166/325; 137/515; 137/527

[58] Field of Search ..... 166/319, 325, 332, 334, 166/386; 137/515, 527

[56] References Cited

U.S. PATENT DOCUMENTS

| | | | |
|---|---|---|---|
| 1,871,536 | 8/1932 | Le Bus | 137/515 |
| 2,342,485 | 2/1944 | Percifield, Jr. | 137/527 X |
| 2,780,290 | 2/1957 | Natho | 166/319 X |
| 3,482,603 | 12/1969 | Outcalt | 137/527 |
| 3,817,278 | 6/1974 | Elliot | 137/527 |

FOREIGN PATENT DOCUMENTS

| | | | |
|---|---|---|---|
| 6336 | of 1909 | United Kingdom | 137/527 |

*Primary Examiner*—David J. Bagnell
*Attorney, Agent, or Firm*—Roland O. Cox

[57] ABSTRACT

A flapper valve assembly when closed permits flow through in one direction and prevents flow in the opposite direction. When open, two way flow may occur and the flapper valve member is biased toward closed position, to sealingly engage an annular seat, by one or more springs in the wall of the flapper valve housing. This structure provides a greater closing force applied to the flapper valve through a tension member connected to the flapper valve hinge. Three forms of tension members are disclosed.

2 Claims, 3 Drawing Sheets

FLAPPER VALVE

BACKGROUND OF THE INVENTION

The invention disclosed herein pertains to a flapper type valve having a flapper member biased to sealingly engage an annular seat. Flapper valves are particularly useful in flow conduits and well safety valves to permit flow therethrough in one direction and prevent flow in the opposite direction.

A multitude of forms of flapper valves (sometimes called flapper check or back pressure valves) have been known and used for many years to control flow in petroleum industry pipe lines and producing wells. A problem shared by most flapper valves is insufficient bias or rotational closure force to move the flapper into (or "cut") a high mass flow rate stream for closure. The rotational closing force has usually been provided by torsion springs. Many forms of torsion springs have been used in an attempt to develop more flapper closing force, especially when large diameter flapper valves are used on well packers or subsurface safety valves in the vertical position in well conduits where closing springs must initially overcome the weight of flapper valves. The problem is aggravated by the fact that there is usually not space to house a large torsion spring designed to provide maximum closing force in a well packer or subsurface safety valve.

An example of a flapper or back pressure valve utilizing a torsion spring for closure and attachable to a number of forms of well packers, is shown on page 52 of "Otis Products and Services" (OEC 5516), Sep. 1989, a publication of Otis Engineering Corporation, P.O. Box 819052, Dallas, Tex. 75381-9052.

A expendable flapper valve is shown in U.S. Pat. No. 4,813,481 to Sproul et al. This flapper valve assembly includes a frangible valve closure member supported by an elastomeric hinge.

The DUAL FLAPPER VALVE ASSEMBLY of U.S. Pat. No. 4,846,281 to Clary et al, permits a well logging operation to be carried out after gravel packing a well.

A number of torsion spring flapper valves are shown used in the inverted position for well gravel packing operations in U.S. Pat. Nos. 4,378,842, 4,378,847 and 4,420,041 to Patel.

U.S. Pat. No. 4,890,674 to Le covers a torsion spring flapper valve used in a subsurface safety valve which can be closed rapidly without damage to the flapper closure member or safety valve operator tube.

The use of a torsion spring flapper valve as the valve closure member in a surface controlled subsurface safety valve is disclosed in U.S. Pat. No. 4,945,993 to Dickson and Smith.

U S. Pat. No. 4,216,830 discloses a subsurface well safety valve having a hinged flapper closure element connected to an operator element by similar forms of connectors. These connectors are not springs but each has a torsional section.

U.S. Pat. No. 3,356,145 to Fredd for WELL TOOLS depicts the use of a stretched coil spring to bias the flapper valve toward closed position. The publication reference and patents previously referenced are incorporated for all purposes herein.

DISCLOSURE OF INVENTION

The present invention provides various structures of a flapper valve assembly wherein the closing force, force available to rotate the flapper valve member into sealing engagement with the annular seat member, is much greater than in conventional flapper valve assemblies where this force is supplied by torsion springs. There is never sufficient space in a conventional flapper assembly used on relatively thin walled well tools to house a torsion spring designed to impart maximum rotational closing force to the valve member of a flapper valve assembly.

The invention flapper valve assembly utilizes the greater forces available from one or more coil or belleville washer springs applied through a tension member which is connected eccentrically to the flapper valve hinge to provide a lever arm to convert the greater spring force into rotational force for urging the flapper valve toward and holding it in closed position sealingly engaging the annular seat.

An object of this invention is to provide an improved flapper valve assembly having greater force for moving the flapper valve member to closed position.

Another object of this invention is to provide an improved flapper valve assembly having one or more closing springs in the wall of the assembly housing.

Another object of this invention is to provide a flapper valve assembly wherein one or more springs may be used to furnish greater flapper valve member closing force.

Another object of this invention is to provide a flapper valve assembly which utilizes a tension member for transmitting greater spring closing force to the flapper valve member.

Another object of this invention is to provide a flapper valve assembly which utilizes either a rigid or flexible tension member.

DESCRIPTION OF THE PREFERRED EMBODIMENTS

Figure 1:
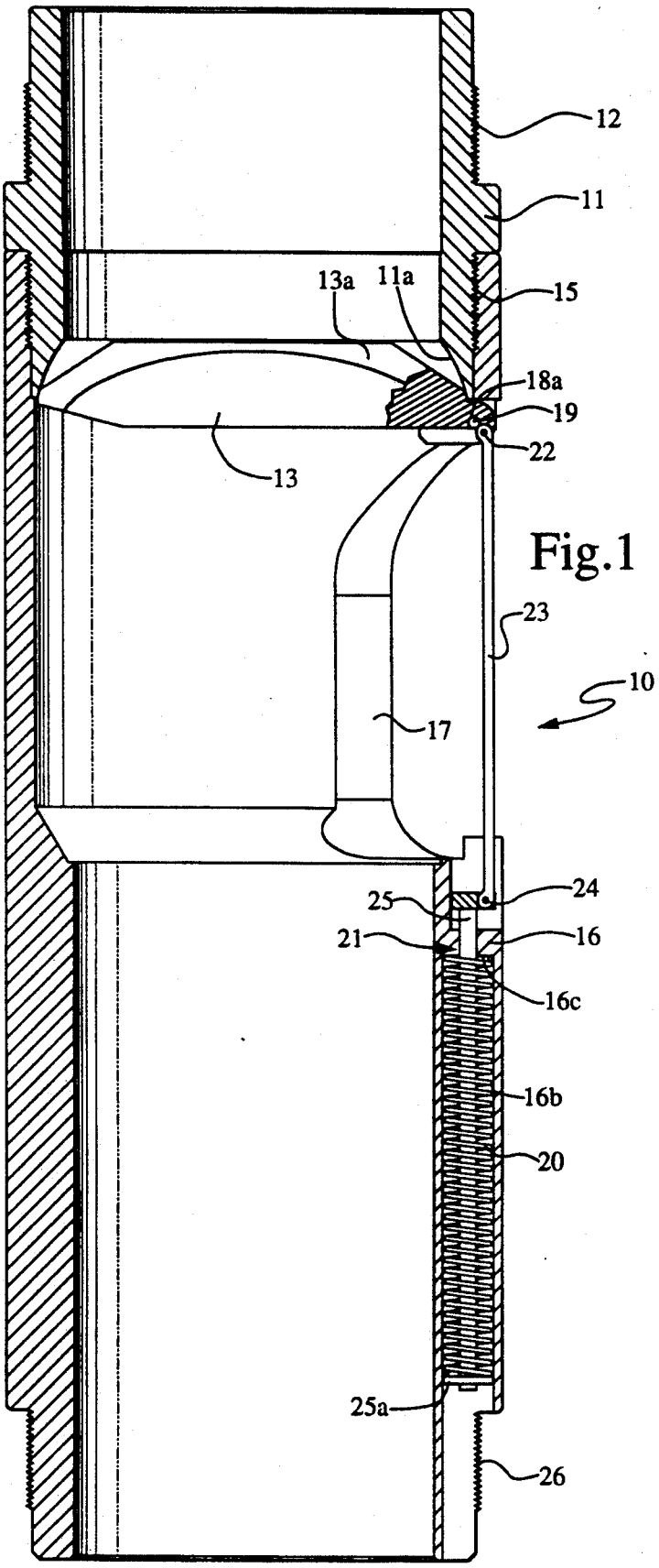
FIG. 1 is an elevational drawing in section showing one form of the invention flapper valve assembly having a link and spring rod in closed position.

FIG. 1 depicts the invention flapper valve assembly 10 having an annular seat member 11. The seat member has a sealing surface 11*a* and is connectible to a well tool with an appropriate connection at 12. The flapper valve member 13, which has a sealing surface 13*a*, is shown in the closed position where valve sealing surface 13*a* is sealingly engaging seat sealing surface 11*a* and flow from below to above the flapper valve in flow passage 14 is prevented. Connected to seat member 11 at 15 is a housing member 16. This housing member has an opening 17 into which the flapper valve is moved when in full open position. The flapper valve has a hinge 18 and is mounted on the housing with a hinge pin 19 through a hole in the hinge 18*a* and a hole in the housing member 16a so it can be moved about 90° from closed to open position (see FIG. 2) while pivoting about the hinge. When moved from closed to open position, the flapper valve is constantly biased toward closed position by spring 20, which is housed in hole 16a having an internal shoulder 16c. The closing bias on the flapper valve is applied through a tension member 21 which compresses spring 20 when the flapper valve is moved to open position. The other end of the tension member is pivotally and eccentrically connected to the flapper hinge by a hinge pin 22 through a hole in the tension member link 23 and flapper hinge. The tension member link is pivotally connected by a hinge pin 24 to a spring rod 25 having a head 25a. One end of spring 20 contacts shoulder 16c in hole 16b and the other end of the spring contacts rod head 25a. There is a connection on housing 16 at 26 for connection of a guide or connection to a well tool.

When the present flapper valve assembly is used on a well tool to permit flow through passage 14 from above flapper valve 13 and prevent flow from below flapper valve 13 to above valve 13, the flapper valve is held in closed position sealingly engaging seat 11 by spring 20. To open the flapper valve for downward flow in passage 14, pressure applied above the flapper valve in passage 14 which is higher than pressure below the flapper valve in passage 14 will open the flapper valve to flow from above, but when the pressure above is less than the pressure below, the spring bias will automatically return the valve to closed position.

Figure 2:
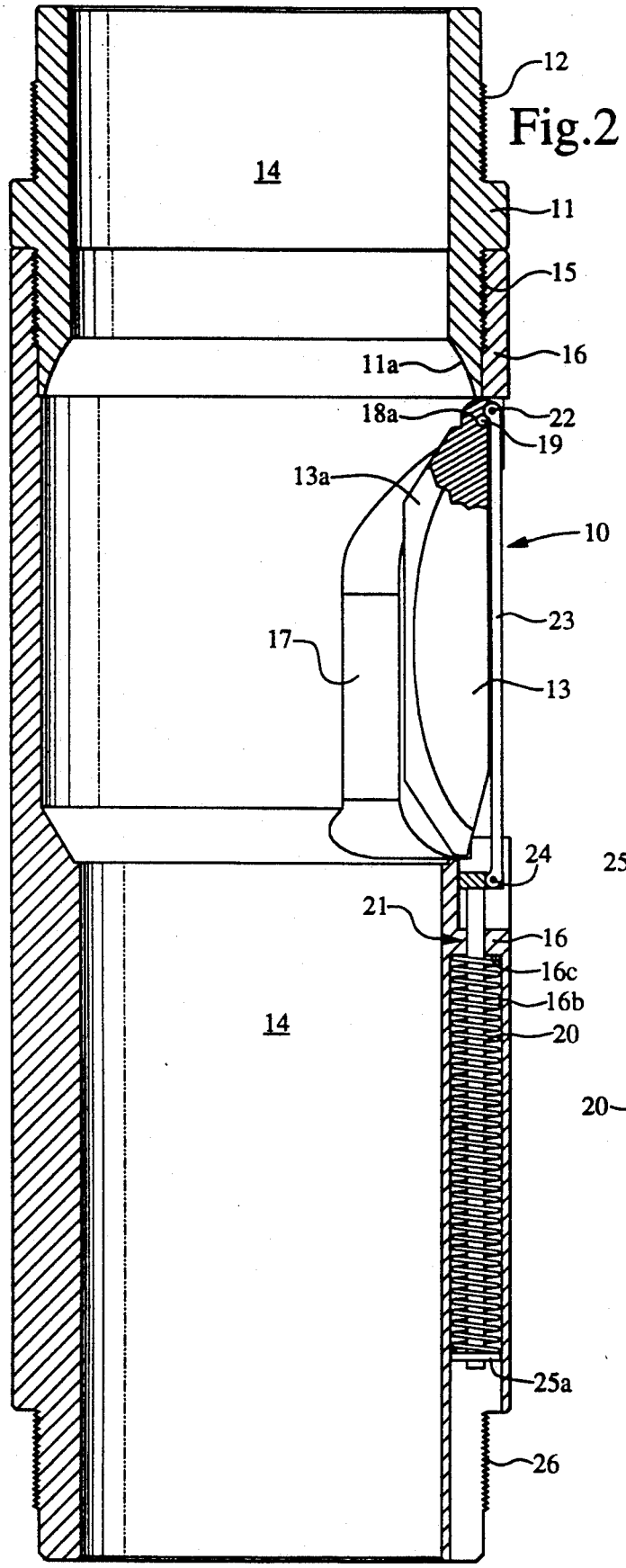
FIG. 2 is a drawing similar to that of FIG. 1 showing the same flapper valve assembly form in open position.

Lowering a rod or tube (not shown) having a diameter near the inside diameter of annular seat 11 from above the flapper valve in passage 14, will move the flapper to full open position as shown in FIG. 2. As the flapper valve is moved open, spring 20 is compressed by upward movement of the tension member. As long as the spring is compressed, the tension member is applying a greater force biasing the flapper valve toward closed position. On raising the tube in passage 14 to above the flapper valve, the spring in permitted to extend moving the tension member downward and rotating the flapper valve to closed position.

Figure 5:
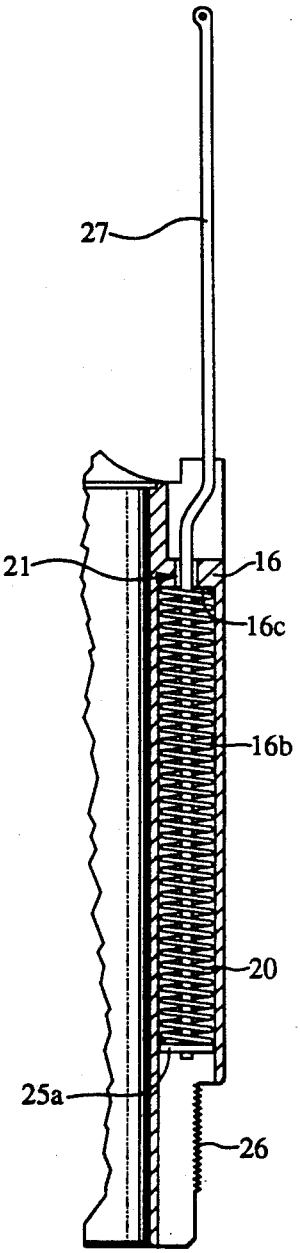
FIG. 5 is a drawing of a fragment of FIG. 2 showing use of a rod as tension member.

FIG. 5 shows a form of the invention flapper valve assembly wherein a flexible rod 27 is utilized as the tension member conveying the spring bias to flapper valve member 13.

Figure 6:
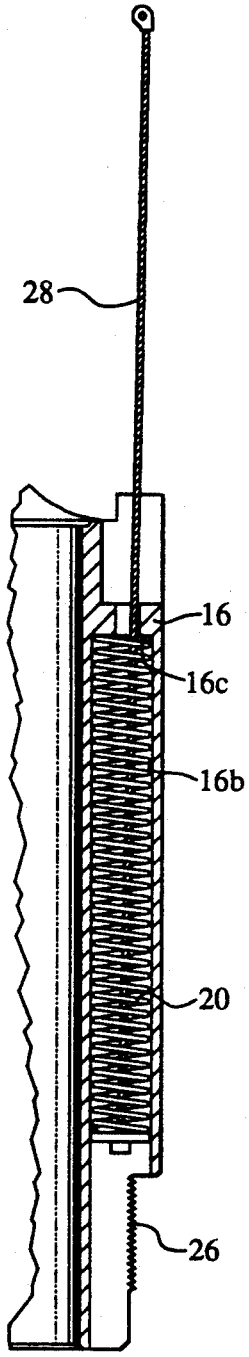
FIG. 6 is a drawing of a fragment of FIG. 2 showing use of a cable as tension member.

FIG. 6 shows another form of the present flapper valve assembly wherein a cable 28 is used for the tension member.

Figure 3:
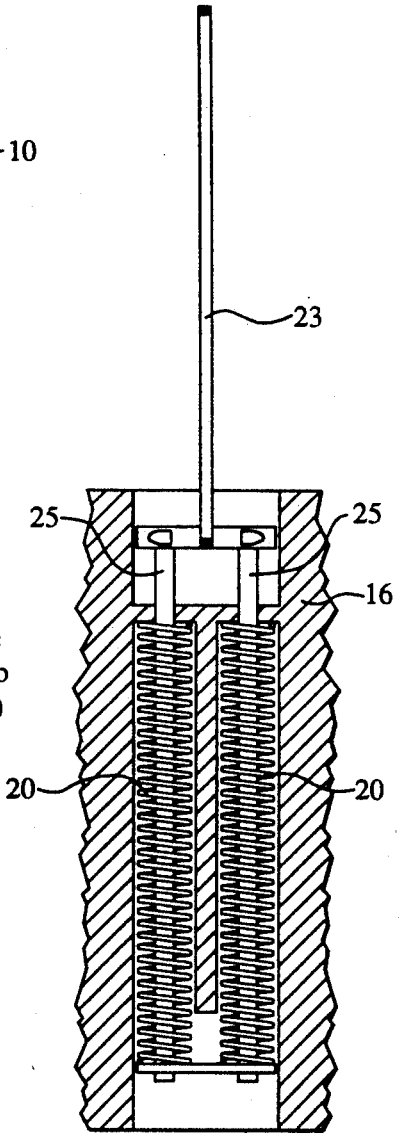
FIG. 3 is a drawing of a fragment of a right side view of the invention flapper valve assembly of FIG. 2 showing the use of two springs and spring rods.
Figure 4:
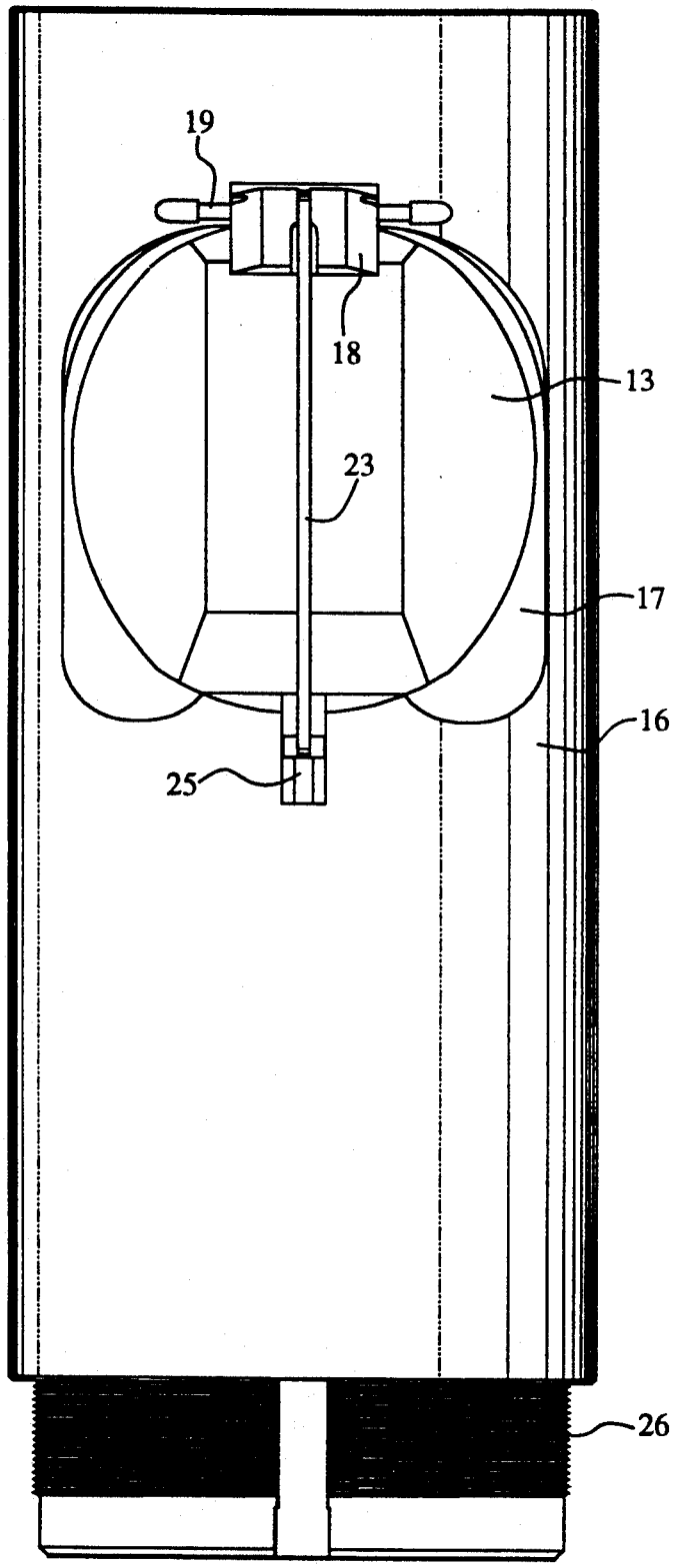
FIG. 4 is a drawing in elevation of the right side view of FIG. 2.

FIG. 3 shows structure for utilizing two (or more) springs to increase the force biasing the flapper towards and holding it in closed position.

What is claimed is:

1. A flapper valve comprising:

(a) a cylindrical housing having a wall, said wall having at least one longitudinal hole therein;

(b) a valve member having a hinge, said hinge pivotally connected to said housing;

(c) an annular seat member connected in said housing, said seat member having a flow passage therethrough, said valve member moveable between open position where two way flow may occur through said seat member and closed position where said valve member sealingly engages said seat member and closes said seat member flow passage to upward flow; and (d) means for biasing said valve member toward closed position including:

a spring mounted in each housing wall hole, a cable connected to and extending from each spring said cable pivotally and eccentrically connected to said valve member hinge so that when said valve member is moved toward open position, said spring is compressed causing said cable to urge said valve member toward closed position.

2. A flapper valve comprising:

(a) a cylindrical housing having a wall, said wall having at least one longitudinal hole therein, each said hole having an internal shoulder, (b) a valve member having a hinge and a sealing surface thereon, said hinge pivotally connected to said housing;

(c) an annular seat member connected in said housing, said seat member having a flow passage therethrough and a sealing surface therein, said valve member moveable between open position where two way flow may occur through said seat flow passage and closed position where said valve sealing surface sealingly engages said seat member sealing surface to close said seat flow passage to upward flow; and (d) means for biasing said valve member toward closed position including:

a spring mounted in each housing wall hole, a cable connected to and extending from each spring, said cable eccentrically and pivotally connected to said valve member hinge so that when said valve member is moved toward open position, said spring is compressed against said hole shoulder, causing said cable to urge said valve member toward closed position.

* * * * *